US012048871B2

(12) United States Patent
Partridge et al.

(10) Patent No.: US 12,048,871 B2
(45) Date of Patent: Jul. 30, 2024

(54) BINDING FOR SNOWBOARD, KITESURF OR WAKEBOARD, WITH A HIGHBACK THAT IS ROTATABLY CONTROLLED BY A LEVER USED AS A BOOT RAMP

(71) Applicant: NIDECKER S.A., Rolle (CH)

(72) Inventors: David Partridge, Wellington (NZ); David Fernandez, Grand-Lancy (CH); Jean-François Pelchat, Whistler (CA)

(73) Assignee: NIDECKER SA, Rolle (CH)

( * ) Notice: Subject to any disclaimer, the term of this patent is extended or adjusted under 35 U.S.C. 154(b) by 0 days.

(21) Appl. No.: 17/921,192

(22) PCT Filed: May 6, 2021

(86) PCT No.: PCT/EP2021/062089
§ 371 (c)(1),
(2) Date: Oct. 25, 2022

(87) PCT Pub. No.: WO2021/224437
PCT Pub. Date: Nov. 11, 2021

(65) Prior Publication Data

US 2023/0166176 A1 Jun. 1, 2023

(30) Foreign Application Priority Data

May 7, 2020 (FR) ..... 2004572

(51) Int. Cl.
*A63C 10/06* (2012.01)
*A63C 10/24* (2012.01)

(52) U.S. Cl.
CPC ..... *A63C 10/06* (2013.01); *A63C 10/24* (2013.01)

(58) Field of Classification Search
CPC ..... A63C 10/02; A63C 10/106; A63C 10/24
See application file for complete search history.

(56) References Cited

U.S. PATENT DOCUMENTS 6,155,577 A * 12/2000 Okajima ..... A63C 10/24 280/613
6,267,403 B1 7/2001 Bossin et al.
(Continued)

FOREIGN PATENT DOCUMENTS

| | | | |
|---|---|---|---|
| EP | 0824942 | A1 | 2/1998 |
| WO | 9915245 | A1 | 4/1999 |
| WO | 2020020797 | A1 | 1/2020 |

OTHER PUBLICATIONS

International Search Report (with English Translation) and Written Opinion (with Machine Translation) issued on Jul. 22, 2021, in connection with corresponding International Application No. PCT/EP2021/062089; 17 pages.
(Continued)

*Primary Examiner* — Brian L Swenson
(74) *Attorney, Agent, or Firm* — Maier & Maier, PLLC

(57) ABSTRACT

A binding for a snowboard, a kitesurf or a wakeboard, including a base, a highback that is movable around a first axis of rotation mounted on the base and a lever, of which a power lever arm controls, rotatably relative to the base, a resistance lever arm that cooperates with the highback to move it around the first axis of rotation between an open position and a closed position. The lever pivots around a second axis of rotation mounted on a bow of the base and in opposition to a toe strap relative to the first axis of rotation so that the power lever arm can be used as a ramp in counterforce against a stopper of the toe strap to move the highback between the open position and the closed position.

10 Claims, 8 Drawing Sheets

(56) References Cited

U.S. PATENT DOCUMENTS

| | | | | |
|---|---|---|---|---|
| 6,406,040 | B1 | 6/2002 | Thorn | |
| 6,416,075 | B1 * | 7/2002 | Laughlin | A63C 10/06 280/624 |
| 6,679,515 | B2 * | 1/2004 | Carrasca | A63C 10/06 280/14.22 |
| 10,179,272 | B2 | 1/2019 | Kavarsky, Jr. et al. | |
| 2003/0075885 | A1 * | 4/2003 | Laughlin | A63C 10/10 280/14.22 |
| 2003/0141701 | A1 * | 7/2003 | Holzer | A63C 10/04 280/618 |
| 2018/0296903 | A1 * | 10/2018 | Kavarsky, Jr. | A63C 10/103 |

OTHER PUBLICATIONS

International Preliminary Report on Patentability (with English Translation) issued on Sep. 2, 2022, in connection with corresponding International Application No. PCT/EP2021/062089; 18 pages.

* cited by examiner

[Fig. 1]
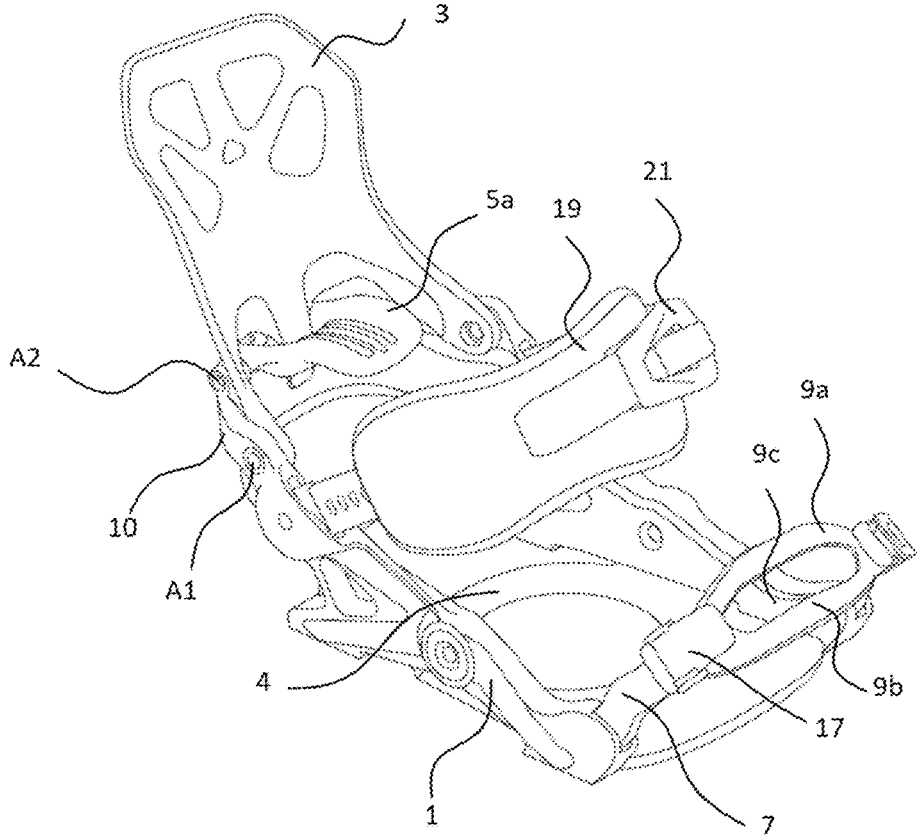
[Fig. 2]
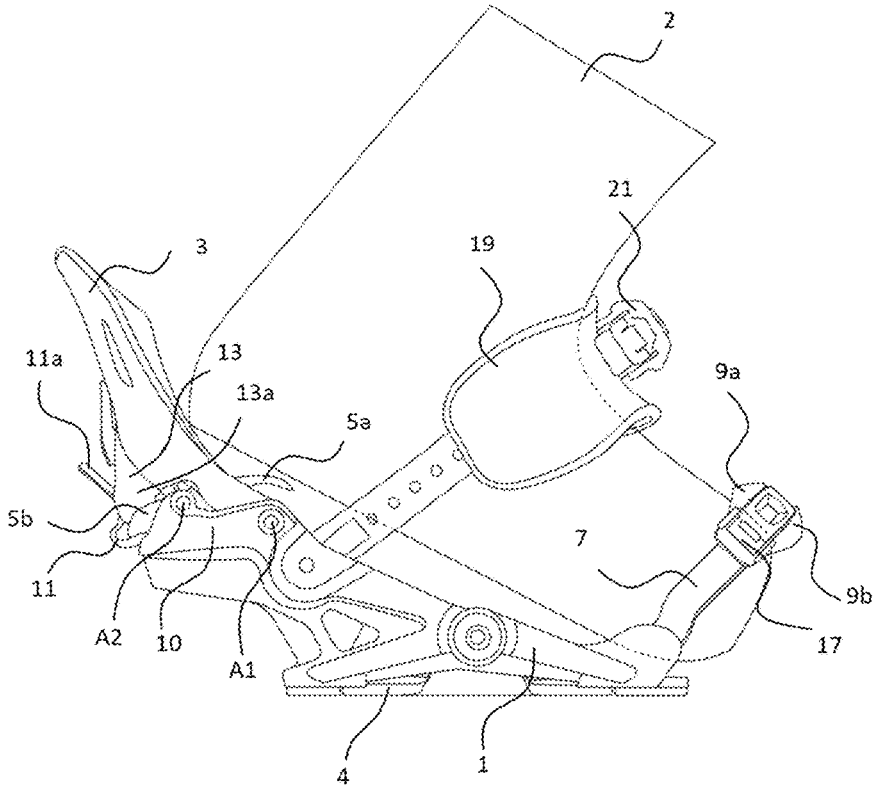

[Fig. 3]
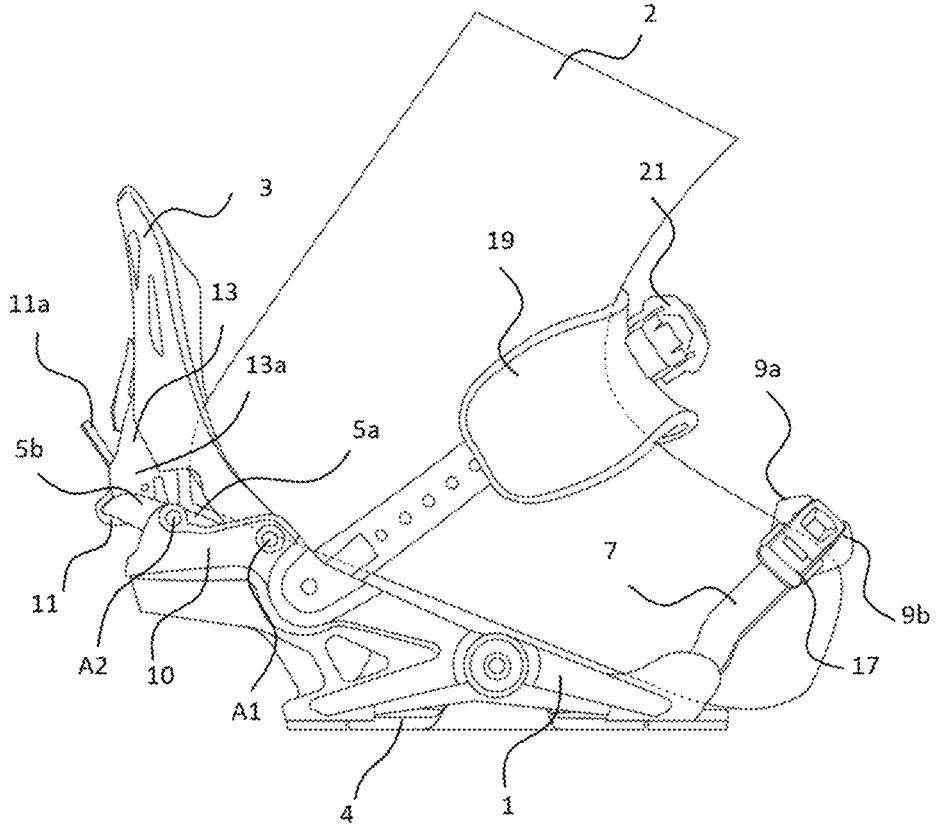
[Fig. 4]
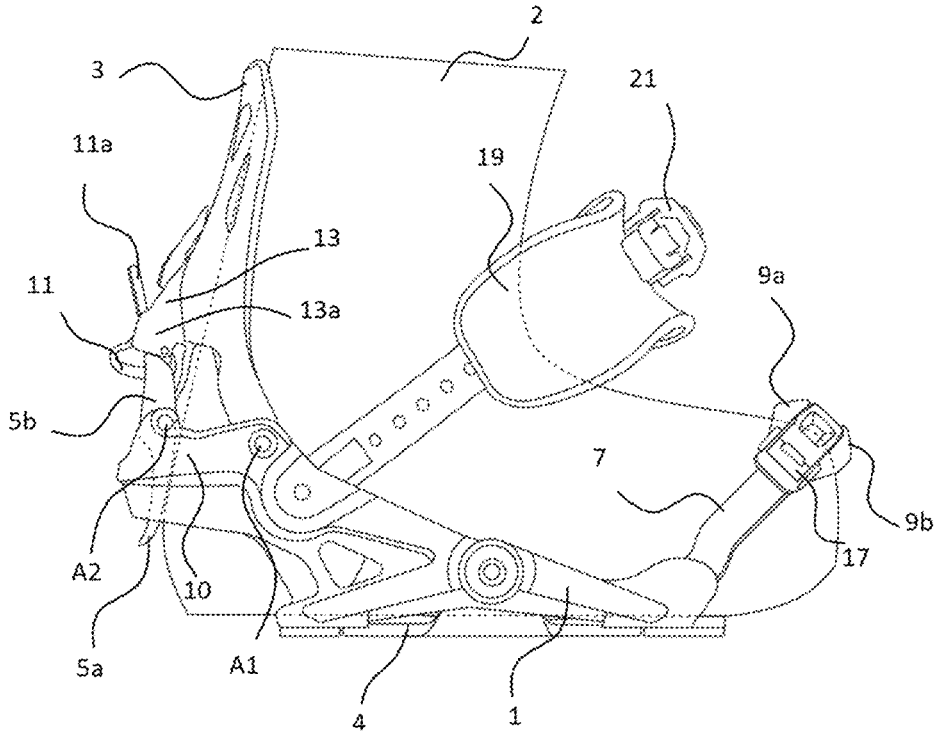

[Fig. 5]
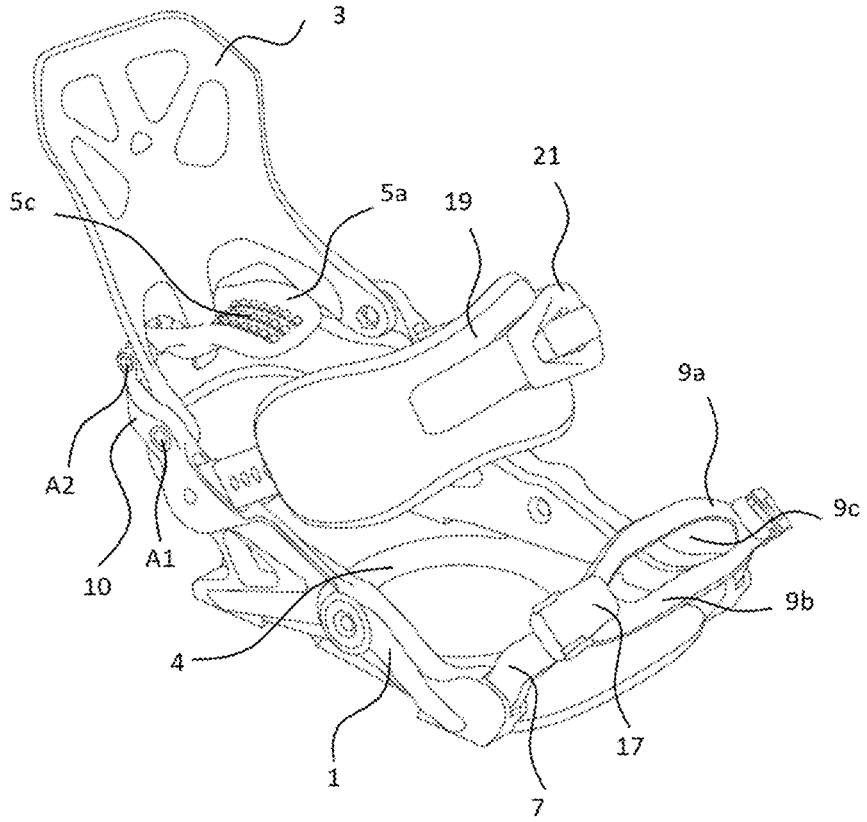
[Fig. 6]
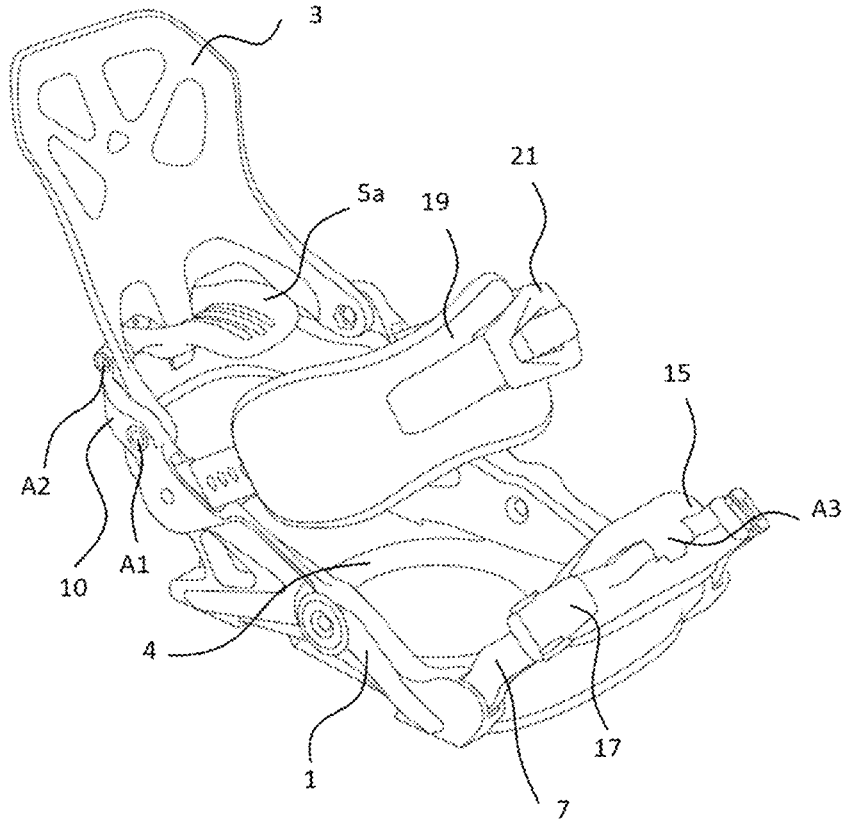

[Fig. 7]
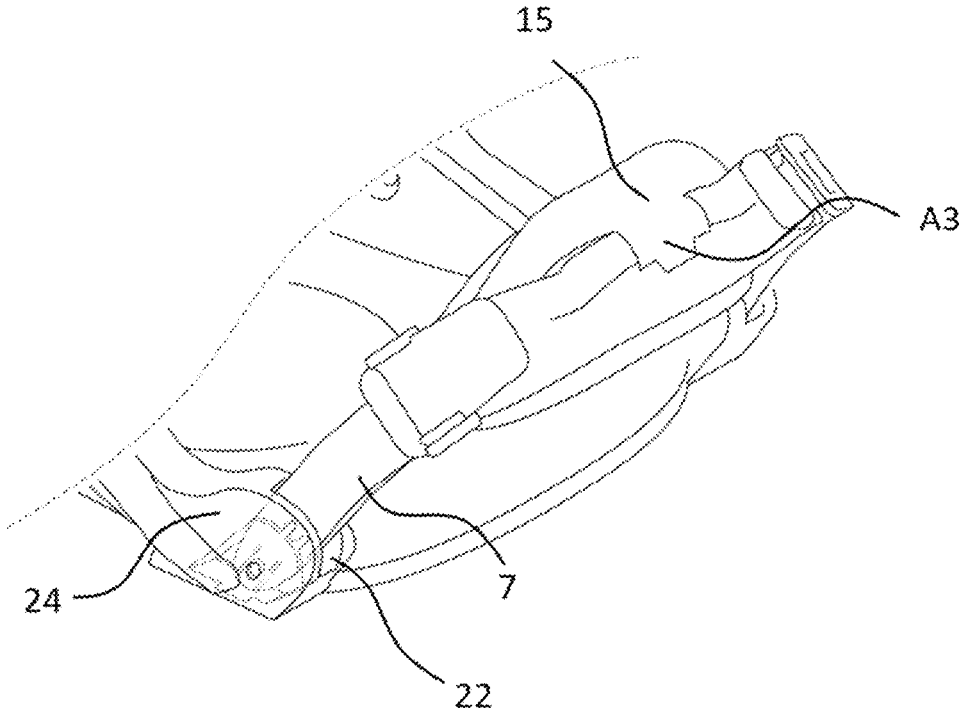
[Fig. 8]
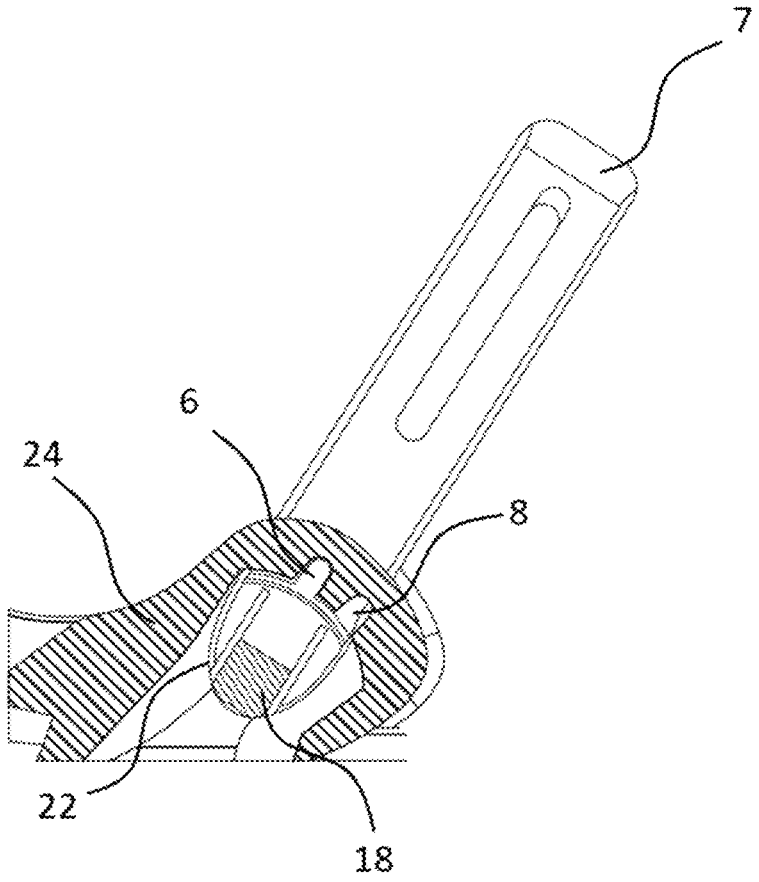

[Fig. 9]
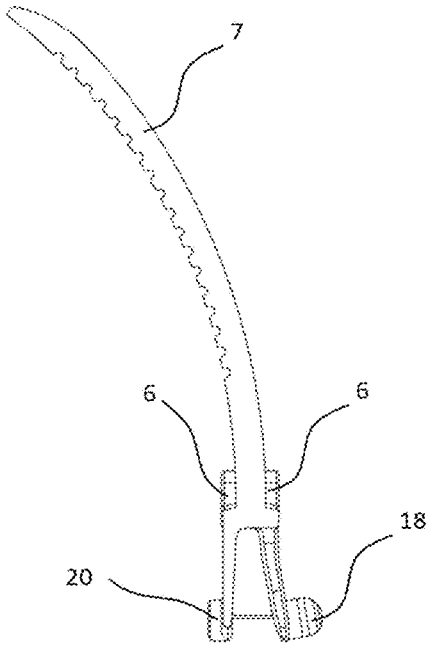
[Fig. 10]
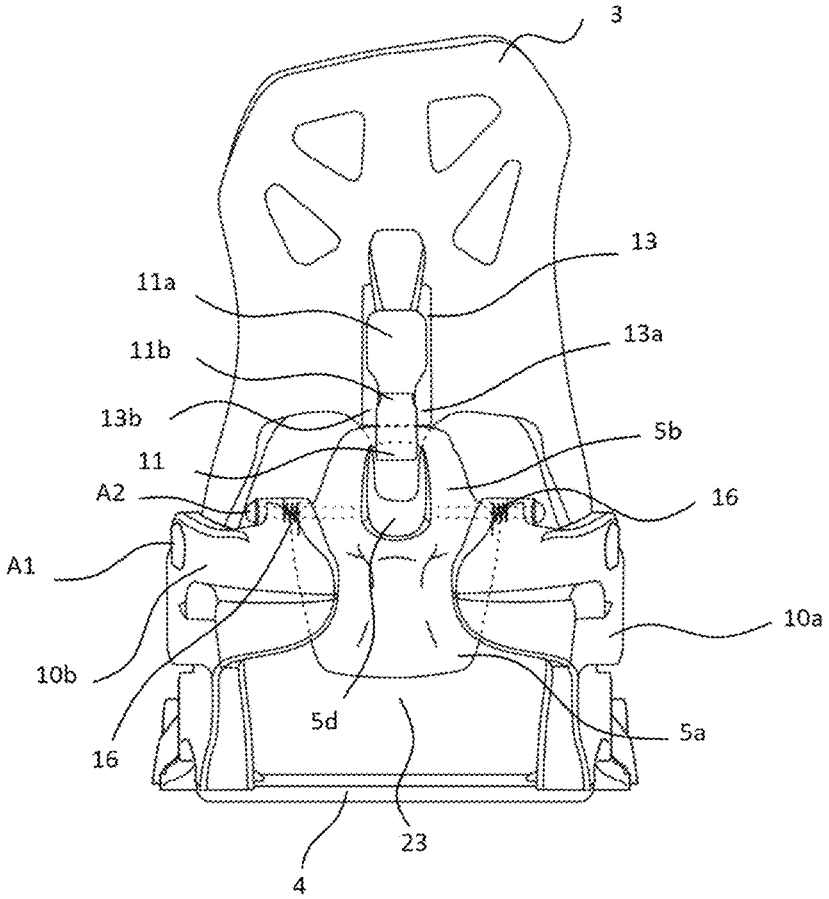

[Fig. 11]
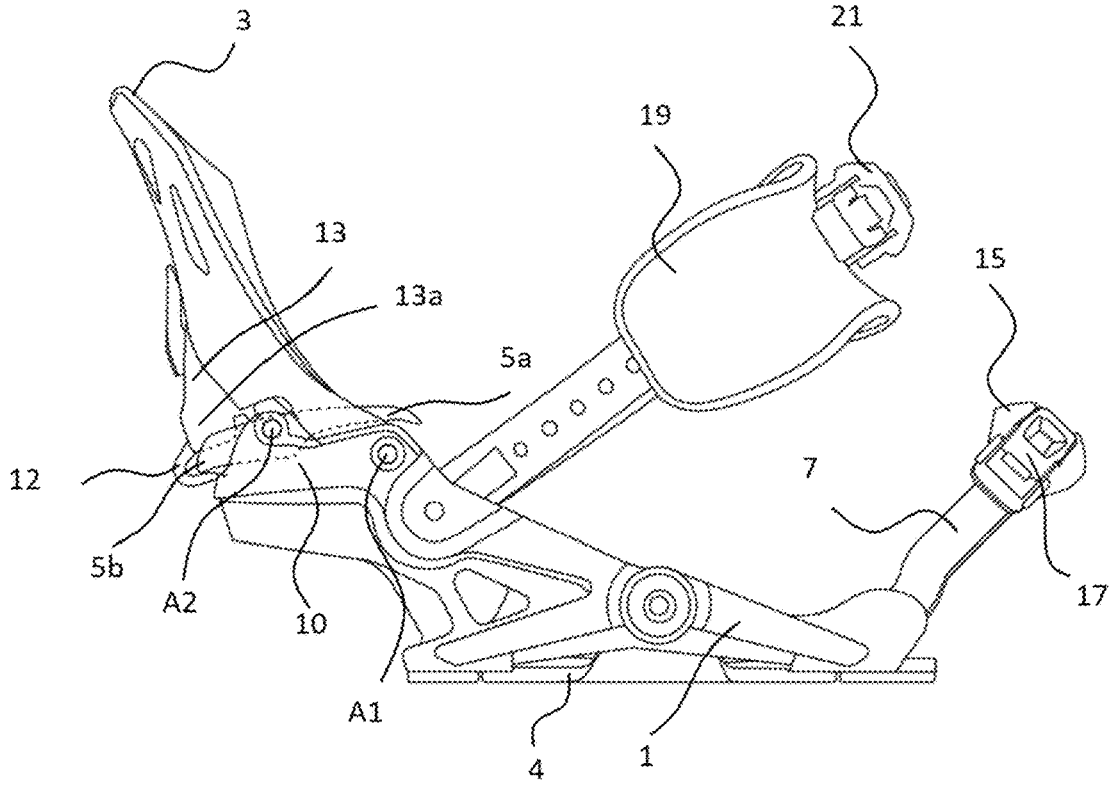
[Fig. 12]
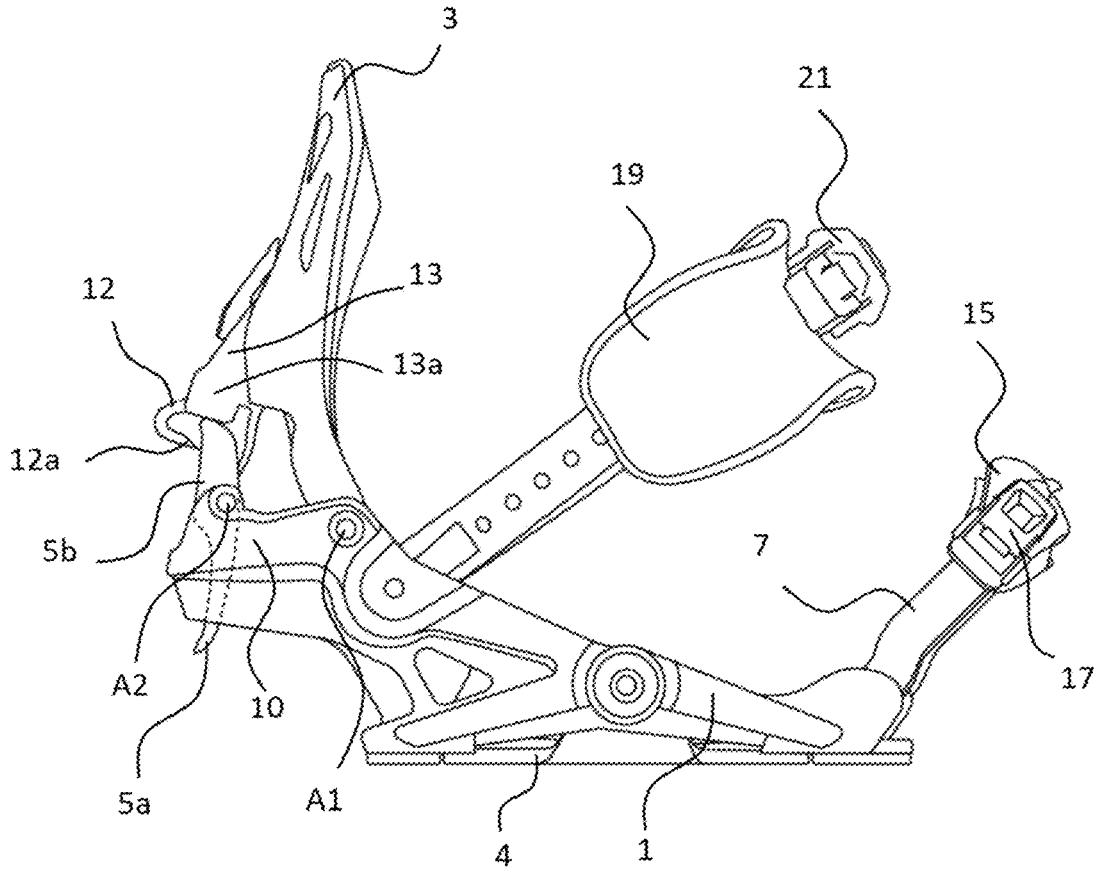

[Fig. 13]
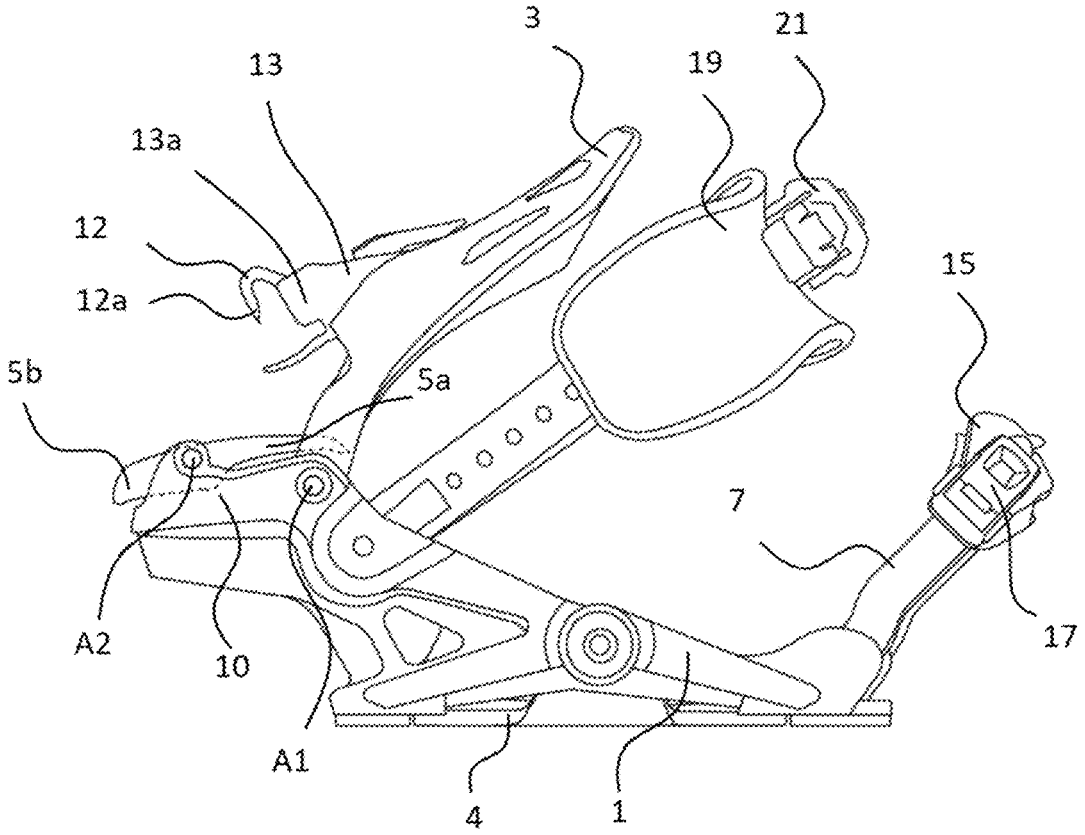
[Fig. 14]
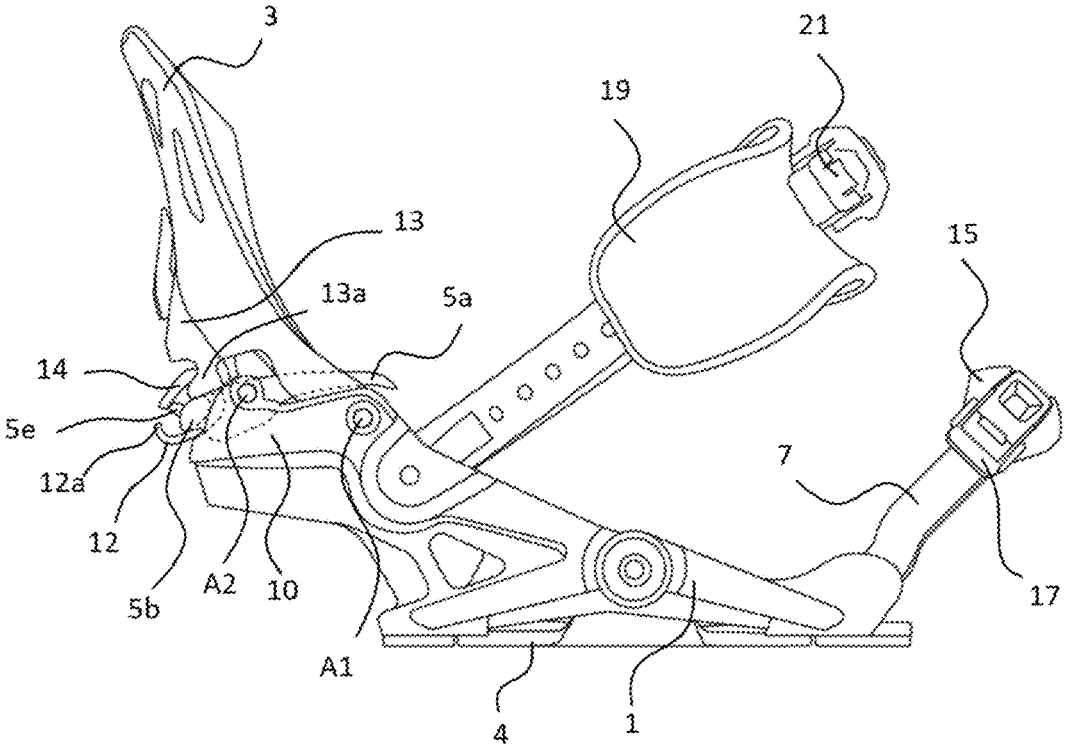

[Fig. 15]
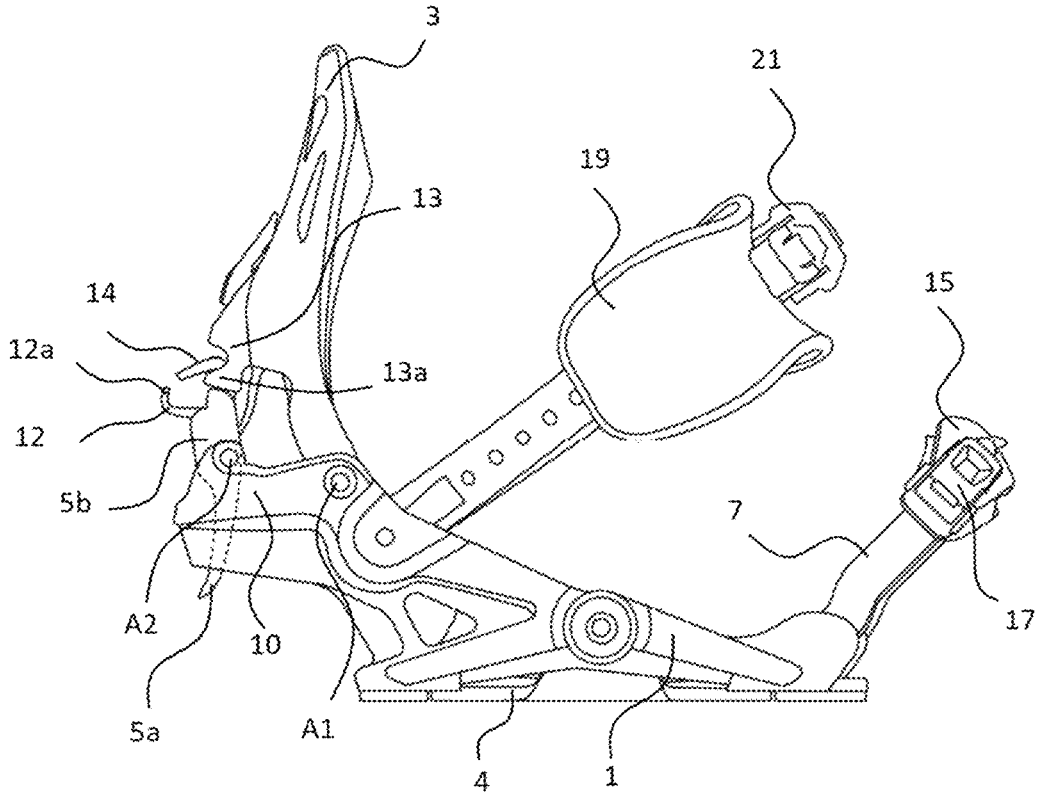
[Fig. 16]
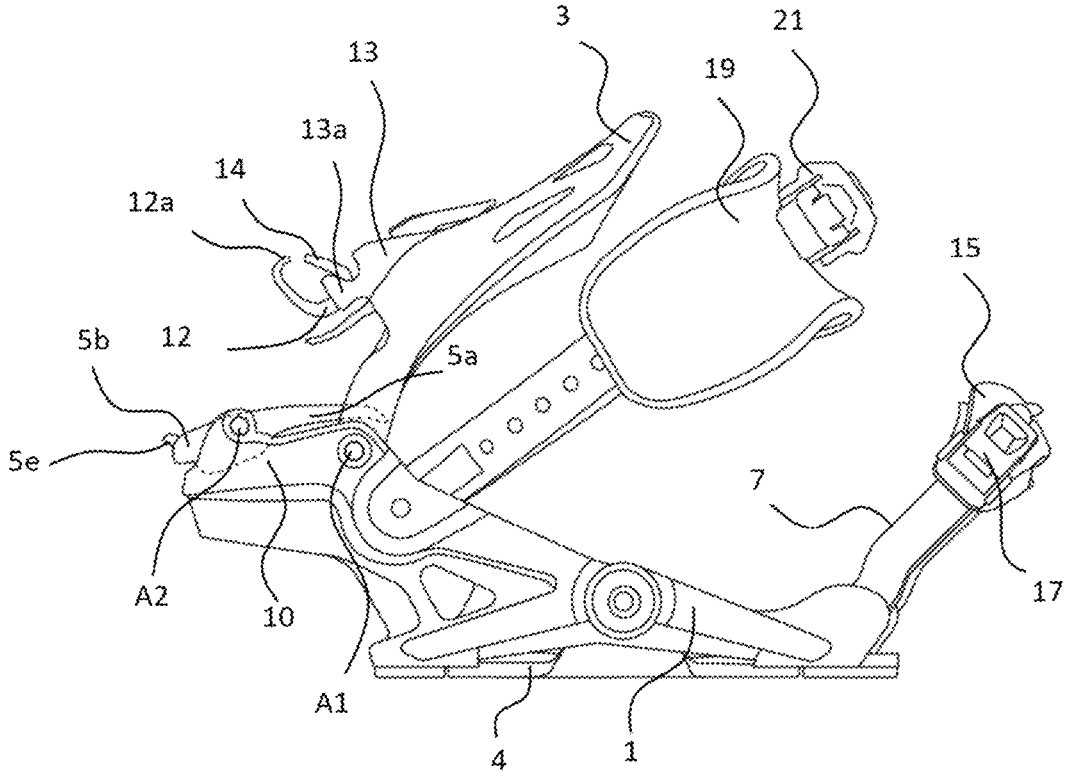

BINDING FOR SNOWBOARD, KITESURF OR WAKEBOARD, WITH A HIGHBACK THAT IS ROTATABLY CONTROLLED BY A LEVER USED AS A BOOT RAMP

FIELD

The invention relates to a binding for a snowboard, a kitesurf or a wakeboard, in particular comprising a base, a highback that is movable around a first axis of rotation mounted on the base and a lever, of which a power lever arm controls, rotatably relative to the base, a resistance lever arm that cooperates with the highback to move it around the first axis of rotation between an open position and a closed position.

BACKGROUND

A binding for snowboard of that kind is known from the document EP 824 942. The lever is mounted around the same first axis of rotation as the highback, while the power lever arm is split to make it possible to pass the heel of the user's boot through it to press a traverse bar. This way, the two power lever arms and the traverse bar are used as a pedal that the boot presses against the mounting base in the closed position.

The document WO 2020/020797 discloses a binding for a snowboard that includes a base, a highback that is movable around a first axis of rotation mounted on the base and a lever that cooperates with the highback to move it around the first axis of rotation. A connecting rod hinges the lever around a second axis of rotation that is mounted on the base and in the same position opposite to the first axis of rotation as a stopper of the base. In this arrangement, said lever is used as a pedal that, once again, the user's boot presses against the mounting base or against the snowboard itself in the closed position.

The document U.S. Pat. No. 6,267,403 discloses a binding for snowboard including a base and a lever, in which a lever arm rotatably controls an opposite lever arm around a second axis of rotation. The lever has notches to use as a ratchet system and lock a shoe that specially has an axis at the buttress to cooperate with the notches. When there is a highback, the second axis of rotation is mounted on the highback itself. In this case, the ratchet lock lever pivots independently from any rotation of the highback.

These documents show a prior art, where the power lever arm is used as a pedal with restricted rotation in close position by the mounting base or by the snowboard itself. An example has a lever without this restriction, but that is used as a ratchet lock independently from any rotation of the highback, on which the lever is mounted.

SUMMARY

One of the goals of the invention is thus to change the type of binding for snowboards as described above, considering the rotation of the power lever arm, and then considering its efficiency when putting on shoes, when it controls the resistance lever arm to move the highback from the open position to the closed position. In addition, the invention shall have to apply to kitesurfs or wakeboards.

To do so, the invention relates to a binding for snowboard according to the introductive statement, characterized in that the lever pivots around a second axis of rotation that is mounted on an arch of the base and in opposition to a toe strap relative to the first axis of rotation, so that the power lever arm can be used as a ramp in counterforce against a stopper of the toe strap, when it controls the resistance lever arm, to move the highback between the open position and the closed position.

When putting on a binding according to the invention, the tip of a user's boot or inner shoe is received by the stopper of the toe strap, while the user delivers a force on the power lever arm closest to the heel of the boot by positioning the second axis of rotation opposite to the stopper in relation to the first axis of rotation. During the swivelling of the lever around the second axis of rotation, the user's boot moves along the power lever arm that is used as a sliding ramp or possibly as a bearing in counterforce relative to the stopper with the toe strap. The power lever arm converts this force into a rotation of the highback, while the rotation of said arm is not restricted by a mounting base or by the snowboard itself. In addition, the function of the power lever arm as a ramp avoids compacting snow between the snowboard or the mounting base and a pedal of the highback.

In the closed position, the power lever arm is locked in rotation in the direction that moves the highback to the open position by the buttress of the user's boot or inner shoe, wherein the tip of the boot or inner shoe is engaged with the toe strap. In reverse rotation, the power lever arm is locked by the arch of the base. To allow locking in both opposite directions against boots or inner shoes of any size, the toe strap has known clamping devices able to change the shoe size of the binding, as defined between the stopper of the toe strap and the arch of the base.

This yields an improved efficiency of the binding according to the invention when putting on, in comparison with the state of the art as previously described.

In an embodiment, the power lever arm can include bearing parts to make the ramp function easier.

In another embodiment, the stopper at the end of the boot can include a tip mounted around an axis of rotation that is mounted on the toe strap to angle itself when putting on and off the shoe.

In another embodiment, the second axis of rotation can be mounted on a first end and on a second end of the bow of the base with an opening between them to reduce the weight of the binding.

The resistance lever arm and the highback may cooperate through a first connecting part and a second connecting part that are fixed to the highback, wherein the resistance lever arm is engaged with the second connecting part through an opening.

The second connecting part is preferably reversibly attached to the first connecting part in the open position and in the closed position of the highback and is detached from the first connecting part in a storage position of the highback. It may also be inserted into the opening of the resistance lever arm in the open position and in the closed position of the highback and may be removed from the opening of the resistance lever arm in the storage position.

BRIEF DESCRIPTION OF THE FIGURES

Other advantages of the invention are described in the presentation below illustrated with the following figures:

FIG. 1 shows a perspective view of a first embodiment of the invention, where the highback is positioned in the open position.

FIG. 2 shows a side view of the first embodiment of the invention, where the highback is positioned in the open position.

FIG. 3 shows a side view of the first embodiment of the invention, where the highback is positioned in an intermediary position.

FIG. 4 shows a side view of the first embodiment of the invention, where the highback is positioned in a closed position.

FIG. 5 shows a perspective view of a variant of the first embodiment of the invention, where the highback is positioned in the open position.

FIG. 6 shows a perspective view of a second embodiment of the invention, where the highback is positioned in the open position.

FIG. 7 shows a partial view of a variant of the first and of the second embodiment of the invention.

FIG. 8 shows a partial sectional view of the embodiment of FIG. 7.

FIG. 9 shows a view of the toe strap of the embodiment of FIG. 7.

FIG. 10 shows a rear view of a third embodiment of the invention, where the highback is in the closed position.

FIG. 11 shows a side view of a fourth embodiment of the invention, where the highback is in the open position.

FIG. 12 shows a side view of the fourth embodiment of the invention, where the highback is in the closed position.

FIG. 13 shows a side view of the fourth embodiment of the invention, where the highback is positioned folded toward the mounting base.

FIG. 14 shows a side view of a fifth embodiment of the invention, where the highback is in the open position.

FIG. 15 shows a side view of the fifth embodiment of the invention, where the highback is in the closed position.

FIG. 16 shows a side view of the fifth embodiment of the invention, where the highback is positioned folded toward the mounting base.

DETAILED DESCRIPTION

In the following presentation, please note that a same item has the same reference on all figures.

A binding for a snowboard, a kitesurf or a wakeboard according to the invention includes a base 1 and a highback 3 movable around a first axis of rotation A1 that is mounted on the base 1. A lever 5 including a power lever arm 5*a* and a resistance lever arm 5*b* is also rotatably movable in reference to the base. The resistance lever arm 5*b* cooperates with the highback 3 to move it around the first axis of rotation A1 between an open position and a closed position when it is rotatably controlled by the power lever arm 5*a*.

As previously exposed, the lever 5 pivots around a second axis of rotation A2 that is mounted on a bow 10 that is raised up a mounting base 4 of the base 1 and that is in opposition to a toe strap 7 relative to the first axis of rotation A1. This arrangement allows the use of the power lever arm 5*a* as a ramp while putting on and off the shoe between the open position and the closed position, in counterforce against a stopper of the toe strap 7.

The FIG. 1 shows a first embodiment of the invention, where the power lever arm 5*a* acts as a sliding ramp in counterforce against a stopper for the tip of a boot or inner shoe, including two branches 9*a*, 9*b* of the toe strap 7 that are separated by a notch 9*c*. The toe strap 7 has a known clamping device 17. It should be noted that the notch can be changed for a deformable structure, either plain or made of meshes.

The FIGS. 2 to 4 show how the invention works.

When putting a shoe on, on FIG. 2, a user's boot or inner shoe 2 is received by the two branches 9*a*, 9*b* of the topper of the toe strap 7, while the user's heel exerts a force onto the power lever arm 5*a*. On FIG. 3, during the swiveling of the lever 5 around the second axis of rotation A2 against the elastic return means, the user's boot or inner shoe 2 moves along the power lever arm 5*a* that is used as a sliding ramp in counterforce relative to the stopper of the toe strap 7. The power lever arm 5*a* rotatably controls the resistance lever arm 5*b* to make it move the highback 3. As described later, the resistance lever arm 5*b* and the highback 3 cooperate through a first connecting part 13 and a second connecting part 11 or 12 that are fixed to the highback 3, wherein the resistance lever arm 5*b* is engaged with the second connecting part 11 or 12 through an opening 5*d* inside the resistance lever arm 5*b*.

In the closed position, on FIG. 4, the power lever arm 5*a* is locked in rotation in the direction that moves the highback 3 to the open position by the buttress of the user's boot or inner shoe 2, wherein the tip of the boot or inner shoe is engaged with the stopper of the toe strap 7. In reverse rotation, the power lever arm 5*a* is locked by the bow 10 of the base 1. An ankle strap 19 that is mounted on the base 1 and that includes a known clamping device 21 makes it possible to lock the boot or the inner shoe 2 in the closed position.

When putting a shoe off, the user unlocks the closed position by unclamping the ankle strap 19, then lifts their heel while the tip of the boot or inner shoe 2 is engaged with the stopper of the toe strap 7. Here again, the lever arm 5*a* is used as a ramp for putting off. The elastic return means follows the movement of the user's heel and controls the highback 3 into the open position thanks to the resistance lever arm 5*b* with cooperation with the second connecting part 11. At the end of the rotation, the resistance lever arm 5*b* is locked by the arch 10.

In the embodiment of the invention according to the FIG. 5, the power lever arm 5*a* includes bearing parts 5*c* to make the ramp function easier when putting on and off the shoe.

The embodiment of the invention illustrated by the FIG. 6 is different from the previous one in that the stopper includes a tip 15 mounted around an axis of rotation A3 mounted on the toe strap 7. This arrangement makes it possible to angle the stopper according to the position of the boot or inner shoe when putting on or off. It improves the comfort of the user and the efficiency of the locking of the power lever arm 5*a* in the closed position by the counterforce of the boot or inner shoe. The tip 15 can be a part attached to the toe strap 7 by the axis of rotation A3 and designed to mate the tip of the boots or of the inner shoes.

The embodiments of the invention illustrated by the FIGS. 7 to 9 are different from the previous one in that the toe strap 7 and the base 1 include mutual rotation locking means 6, 8 that allow the toe strap 7 different adjustment positions to improve, once again, the efficiency of the counterforce by the stopper 9, 15 in reference to the power lever arm 5*a*. Locking means include, for example, notches 8 and reciprocal ribs 6, while the toe strap 7 is provided with elastic pressuring means 18, 20 to engage into a recess 22 of a socket 24 in the base. The embodiment of the invention according to the FIG. 10 is different from the previous ones in that the second axis of rotation A2 is mounted on a first end 10*a* and a second end 10*b* of the base 1, wherein there is an opening 23 between them.

The FIG. 10 also provides a detailed description of the cooperation means between the highback 3 and the resistance lever arm 5*b* implemented in these embodiments.

The first connecting part 13 is secured against the highback 3 and includes two stiffeners 13*a*, 13*b*. The second connecting part 11 includes a tab 11*a* to attach reversibly to the first connecting part 13 in the open position and in the closed position of the highback 3, and can be detached from the first connecting part 13 in a storage position. In the example of FIG. 10, the two stiffeners 13*a*, 13*b* of the first connecting part 13 create a recess where a rod 11*b* is to be inserted, which is carried by the second connecting part 11 and is used as a reversible means of attachment.

When putting on the shoe, the resistance lever arm 5*b* engages with the stiffeners 13*a*, 13*b* of the first connecting part 13 to move the highback 3 into the closed position. When putting off the shoe, the resistance lever arm 5*b* transmits to the highback 3 the force from the elastic return means 16 through the second connecting part 11 that is reversibly attached to the first connecting part 13.

The first and second connecting parts 11 and 13 described above create a connecting loop, where the second connecting part stretches out through the opening 5*d* in the resistance lever arm 5*b* to close in on the first connecting part 13 thanks to the reversible means of attachment 11*b*. Opening the connecting loop makes it possible to turn down the highback 3 around the first axis of rotation A1 in a storage position.

FIGS. 11 to 14, the second connecting part 12 is inserted into the opening 5*d* of the resistance lever arm 5*b*, in the open position and in the closed position of the highback 3 and is removed from the opening 5*d* of the resistance lever arm 5*b* in a storage position of the highback 3. The second connecting part 12 is shaped as a clockwise or anti-clockwise bent hook.

According to a fifth embodiment, it is particularly expected to fix an elastic deformation part 14, for example in the shape of a blade, to the first connecting part 13, preferably between its stiffeners 13*a* and 13*b*, to determine, as per FIG. 14, the open position by pressing a stop 5*e* on the resistance lever arm 5*b*. The elastic deformation of said part 14 allows the highback 3 to adopt an over-opening position that is determined by a compression of said part between the first connecting part 13 and the stop 5*e* on the resistance lever arm 5*b*. This arrangement advantageously reduces the encumbrance of the binding in the open position while making putting on easier from the over-opening position. The user get the over-opening position by pressing the highback 3 while not pressing the power lever arm 5*a* of the lever 5 yet.

Remember that the power lever arm is locked by the arch of the base and not by the mounting base. In the case of a snowboard, this result is particularly beneficial, considering that the possible presence of snow between the boot and the base may hinder the rotation of the power lever arm, hence hinder the complete closing of the binding. In case of water applications, the result is also beneficial in case of accidental obstruction.

The invention claimed is:

1. A binding for a snowboard, a kitesurf or a wakeboard, comprising: a base, a highback that is movable around a first axis of rotation mounted on the base and a lever that pivots around a second axis of rotation mounted on an arch of the base and in opposition to a toe strap relative to the first axis of rotation, so that a power lever arm can be used as a putting-on ramp in counterforce against a stopper of the toe strap, wherein the lever cooperates with the highback through a resistance lever arm while the second axis of rotation is an axis of rotation exclusively between the lever and the base, to allow the resistance lever arm to move the highback around the first axis of rotation between an open position and a closed position, when the resistance lever arm is rotatably controlled around the second axis of rotation by the power lever arm, used as the putting-on ramp.

2. The binding according to claim 1, wherein the stopper includes a tip mounted around an axis of rotation mounted on the toe strap.

3. The binding according to claim 1, wherein the power lever arm has bearing parts.

4. The binding according to claim 1, wherein the toe strap and the base include mutual rotation locking means that allow the toe strap different adjustment positions.

5. The binding to claim 1, wherein the resistance lever arm and the highback cooperate through a first connecting part and a second connecting part that are fixed to the highback, wherein the resistance lever arm is engaged with the second connecting part through an opening.

6. The binding to claim 5, wherein the second connecting part is reversibly attached to the first connecting part in the open position and in the closed position of the highback and is detached from the first connecting part in a storage position of the highback.

7. The binding according to claim 5, wherein the second connecting part is inserted into the opening of the resistance lever arm in the open position and in the closed position of the highback and is removed from the opening of the resistance lever arm in a storage position of the highback.

8. The binding according to claim 7, wherein the second connecting part is shaped as a clockwise or anti-clockwise bent hook.

9. The binding according to claim 5, wherein a part with elastic deformation is tied to the first connecting part to characterize the open position of the highback by pressing a stop fixed on the resistance lever arm.

10. The binding according to claim 1, wherein the second axis of rotation is mounted on a first end and a second end of the arch, wherein there is an opening between them.

* * * * *